US011006773B1

(12) United States Patent
Bi

(10) Patent No.: US 11,006,773 B1
(45) Date of Patent: May 18, 2021

(54) BEVERAGEWARE WITH MULTIPLE OUTLETS

(71) Applicant: Lance S Bi, Buffalo Grove, IL (US)

(72) Inventor: Lance S Bi, Buffalo Grove, IL (US)

( * ) Notice: Subject to any disclaimer, the term of this patent is extended or adjusted under 35 U.S.C. 154(b) by 46 days.

(21) Appl. No.: 16/710,143

(22) Filed: Dec. 11, 2019

(51) Int. Cl.

| | |
|---|---|
| ***A47G 19/00*** | (2006.01) |
| ***A47G 19/12*** | (2006.01) |
| ***B65D 21/00*** | (2006.01) |
| ***B65D 25/28*** | (2006.01) |
| ***B65D 1/04*** | (2006.01) |
| ***A47G 19/22*** | (2006.01) |

(52) U.S. Cl.
CPC ..... *A47G 19/2266* (2013.01); *A47G 19/2227* (2013.01); *A47G 19/12* (2013.01); *A47G 19/22* (2013.01); *A47G 19/2205* (2013.01)

(58) Field of Classification Search
CPC ..... A47G 19/2266; A47G 19/2227; A47G 19/12; A47G 19/22; A47G 19/2205; A47G 2019/122; A47G 21/182; B01F 13/0022; B01F 13/002; B65D 25/28; B65D 25/2882; B65D 25/2891
USPC ..... 220/606, 703; D7/513, 514, 515, 503, D7/509, 533, 534, 545, 547, 901, 396.2, D7/524; D27/162
See application file for complete search history.

(56) References Cited

U.S. PATENT DOCUMENTS

D34,918 S * 8/1901 Wheeler ..... D7/513
2,205,147 A * 6/1940 Madsen ..... B67D 3/0012 99/323.1
D123,103 S * 10/1940 Murray ..... D9/740
2,654,628 A * 10/1953 Klante ..... A47G 23/0208 294/137
D206,943 S * 2/1967 Kinney ..... D7/513
D218,350 S * 8/1970 Marks ..... D7/513
D249,438 S 9/1978 Meier
D251,284 S 3/1979 Weaver
4,560,473 A * 12/1985 David ..... A47G 19/12 210/173
D289,694 S 5/1987 Pickett
D292,157 S * 10/1987 Robinson ..... D7/505
D314,492 S 2/1991 Weller et al.
D319,008 S 8/1991 Leon
D330,857 S 11/1992 Kidd
D332,741 S 1/1993 Turner
D341,774 S 11/1993 Felz
D346,185 S 4/1994 Francis
D355,591 S 2/1995 Weder
D355,592 S 2/1995 Weder
D355,594 S 2/1995 Weder
D355,596 S 2/1995 Weder
D356,032 S 3/1995 Weder
(Continued)

*Primary Examiner* — Gideon R Weinerth
(74) *Attorney, Agent, or Firm* — The Law Offices of Konrad Sherinian, LLC

(57) ABSTRACT

A beverageware includes a container adapted to contain liquid, a base, a leg supporting the container and resting on the base, and a handle disposed in the middle of the container. The container includes a horizontal segment and two vertical segments extending away in the same direction from two opposite ends of the horizontal segment. The container includes a cavity running through the horizontal segment and the two vertical segments. The two vertical segments provide two outlets respectively, the handle extends away from the horizontal segment and is disposed between the two vertical segments.

8 Claims, 2 Drawing Sheets

(56) References Cited

U.S. PATENT DOCUMENTS

D357,541 S 4/1995 Neidell
D359,655 S 6/1995 Hurst
D370,154 S 5/1996 Gruneisen
D371,934 S 7/1996 Gwirko
D375,258 S 11/1996 Weder
D379,023 S 4/1997 August
D379,149 S 5/1997 Powell
D389,734 S 1/1998 Schultz et al.
D391,155 S 2/1998 Edson et al.
D405,843 S * 2/1999 Palardis ..... D21/406
D406,505 S 3/1999 Arroyo
D408,237 S 4/1999 Wysopal
D411,442 S 6/1999 Edson
D416,799 S 11/1999 Adams
6,036,570 A 3/2000 Nadel
D424,375 S 5/2000 D'Arrigo
D436,803 S * 1/2001 Addison ..... D7/509
D444,348 S * 7/2001 Ghasham ..... D7/312
D456,305 S 4/2002 Hopkins
D478,480 S 8/2003 Leon
D511,212 S 11/2005 Whalen
D513,157 S 12/2005 Falt
D524,127 S 7/2006 Lee
D535,157 S 1/2007 Hoehne
D539,622 S 4/2007 Wysopal
D562,073 S 2/2008 Yeh
D565,288 S 4/2008 Hickman
D574,664 S * 8/2008 Thompson ..... D7/515
D575,164 S 8/2008 Billings
D575,165 S 8/2008 Billings
D580,775 S 11/2008 Harris
D587,968 S 3/2009 Campbell
D589,765 S 4/2009 Zuloff
D607,248 S * 1/2010 Lochen ..... D6/515
D607,676 S * 1/2010 Lochen ..... D6/515
D609,044 S * 2/2010 James ..... D7/301
D609,111 S 2/2010 Bentley et al.
D609,987 S 2/2010 Moman
D611,287 S * 3/2010 Lochen ..... A47G 19/12 D7/301
D621,657 S 8/2010 Quinn
D623,938 S 9/2010 Gordon
D653,443 S 2/2012 Roudybush
D663,575 S 7/2012 Carroll et al.
D678,120 S 3/2013 Reetz et al.
D695,005 S 12/2013 Kroupa
D700,846 S 3/2014 Blends
D709,555 S 7/2014 Moore et al.
D713,688 S 9/2014 Thomas
D718,146 S 11/2014 Tussy
D719,033 S 12/2014 Kaddari
D720,926 S 1/2015 Kroupa
D725,392 S 3/2015 Goodwin
D725,437 S * 3/2015 McIntyre ..... D7/398
D735,050 S 7/2015 Tussy
D743,568 S 11/2015 Almonte
D753,506 S 4/2016 Veletakos
D755,577 S 5/2016 Segal
D761,660 S 7/2016 Giles
D775,895 S 1/2017 Mayberry
D789,748 S 6/2017 Peters et al.
D790,897 S * 7/2017 Pecora ..... B67D 3/0012 D7/301
D796,327 S 9/2017 Walbroel et al.
D796,328 S 9/2017 Walbroel et al.
D800,508 S 10/2017 Peters
D807,192 S 1/2018 Haws
D807,694 S 1/2018 Jewett
D821,886 S 7/2018 Paulin et al.
D853,196 S 7/2019 Cramton
D853,792 S 7/2019 Cramton
D856,136 S 8/2019 Marshall
D875,544 S 2/2020 Peters
2008/0277404 A1* 11/2008 Skala ..... A47G 19/2227 220/703
2010/0326453 A1* 12/2010 Chaoui ..... A24F 1/30 131/173
2012/0199546 A1 8/2012 Dieni
2013/0201782 A1* 8/2013 Ruff ..... A47G 19/12 366/130
2013/0306629 A1* 11/2013 Asfaw ..... A47G 19/2266 220/23.2
2017/0042355 A1* 2/2017 Bolland ..... A47G 19/2205

* cited by examiner

BEVERAGEWARE WITH MULTIPLE OUTLETS

CROSS REFERENCE TO RELATED APPLICATIONS

None.

FIELD OF THE DISCLOSURE

The present invention generally relates to a drinkware for containing beverages or liquid foods for drinking or consumption, and more particularly relates to a beverageware with multiple outlets.

DESCRIPTION OF BACKGROUND

Drinkware, such as bear glasses, coffee mugs and water cups, is a common type of devices in people's daily life. These apparatuses are made in different shapes and sizes. However, a conventional drinkware device includes a container part that is adapted to contain and hold beverage or liquid food. The container incorporates one opening (also referred to herein as an outlet). A user of the device fills the container with liquid (such as water, orange juice, apple juice, bear, etc.) through the outlet, and retrieves the contained liquid from the container via the outlet for consumption. When a handle is attached to the container, the user operates the handle to use the drinkware. The handle is located on a side of the container. With or without a handle, the container can also be held between the user's fingers and palm.

Accordingly, there is a need for a new drinkware with a liquid container having two outlets and a handle disposed in the middle of the container.

OBJECTS OF THE DISCLOSED SYSTEM, METHOD, AND APPARATUS

Accordingly, it is an object of this disclosure to provide a drinkware with multiple outlets.

Another object of this disclosure is to provide a drinkware with two outlets.

Another object of this disclosure is to provide a drinkware with two outlets and a handle between the two outlets.

Another object of this disclosure is to provide a drinkware with two outlets and a handle between the two outlets.

Another object of this disclosure is to provide a drinkware with a container having three connected segments, two outlets and a handle between two of the three segments.

Another object of this disclosure is to provide a drinkware with a container having three connected segments, one of which being horizontal while the other two being vertical with two outlets, and a handle extending away from the horizontal segment and being disposed between two vertical segments.

Another object of this disclosure is to provide a drinkware with a container having three connected segments, one of which being horizontal while the other two being vertical with two outlets, a handle extending away from the horizontal segment and being disposed between two vertical segments, a leg supporting the horizontal segment, and a base supporting the leg.

Other advantages of this disclosure will be clear to a person of ordinary skill in the art. It should be understood, however, that a system, an apparatus or a method could practice the disclosure while not achieving all of the enumerated advantages, and that the protected disclosure is defined by the claims.

SUMMARY OF THE DISCLOSURE

Generally speaking, pursuant to the various embodiments, the present disclosure provides a beverageware. The beverageware includes a base, a leg extending upward from the base, and a horizontal container segment supported by the leg and incorporating a first internal cavity. The beverageware also includes two vertical container segments extending upward from the horizontal container segment at two opposite ends of the horizontal container segment. The two vertical container segments incorporate a second internal cavity and a third internal cavity respectively. The second internal cavity and the third internal cavity communicate with the first internal cavity. The two vertical container segments each incorporate an outlet communicating with the second and third internal cavities respectively. In addition, the beverageware includes a vertical handle extending upward from the horizontal container segment. The vertical handle is disposed between the two vertical container segments. The vertical handle and the leg are coaxial. The leg and the vertical handle extend away from the horizontal container segment from a middle point of the horizontal container segment.

Further in accordance with the present teachings is a beverageware that includes a base, a leg extending upward from the base, and a first container segment supported by the leg and incorporating a first internal cavity. The beverageware also includes a second container segment and a third container segment extending upward from the first container segment at two opposite ends of the first container segment. The second container segment incorporates a second internal cavity; and the third container segment incorporates a third internal cavity. The second internal cavity and the third internal cavity both communicate with the first internal cavity. The second container segment incorporates a first outlet communicating with the second internal cavity. The third container segment incorporates a second outlet communicating with the third internal cavity. In addition, the beverageware includes a handle extending upward from the first container segment. The handle is disposed between the second and third container segments. The first container segment is horizontal and the second container segment and the third container segment are vertical. The handle and the leg are vertical and coaxial. The handle and the leg each connect to the first container segment at a middle point of the first container segment. The base incorporates a flat bottom surface. The beverageware is made of a plastic or metal material.

BRIEF DESCRIPTION OF THE DRAWINGS

Although the characteristic features of this disclosure will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

A person of ordinary skills in the art will appreciate that elements of the figures above are illustrated for simplicity and clarity, and are not necessarily drawn to scale. The dimensions of some elements in the figures may have been exaggerated relative to other elements to help understanding of the present teachings. Furthermore, a particular order in which certain elements, parts, components, modules, steps, actions, events and/or processes are described or illustrated may not be actually required. A person of ordinary skills in the art will appreciate that, for the purpose of simplicity and clarity of illustration, some commonly known and well-understood elements that are useful and/or necessary in a commercially feasible embodiment may not be depicted in order to provide a clear view of various embodiments in accordance with the present teachings.

DETAILED DESCRIPTION

Figure 1:
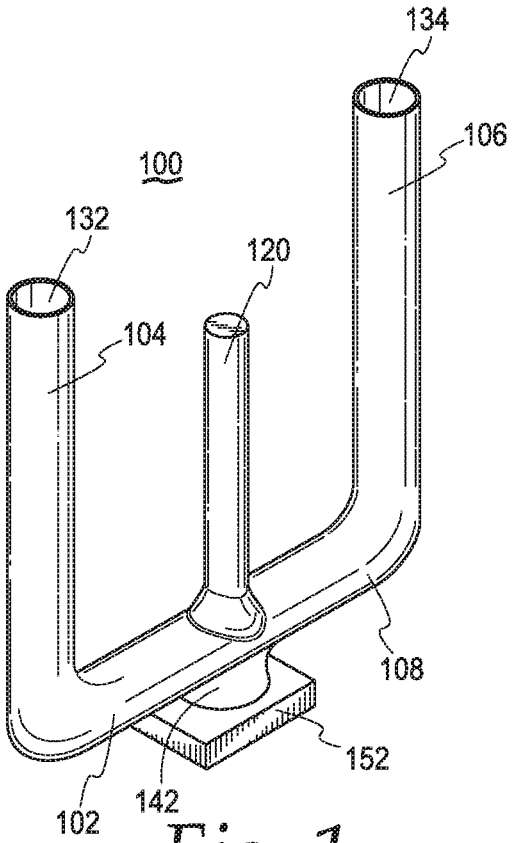
FIG. 1 is a front perspective view of a beverageware in accordance with this disclosure.

Turning to the Figures and to FIG. 1 in particular, a front perspective view of a beverageware is shown and generally indicated at 100. The drinkware 100 includes a liquid container 102 having three elongated container segments 104, 106 and 108, a handle 120 extending away from the segment 108 and disposed between the segments 104-106, a base 152, and a leg 142 supporting the segment 108 and resting on the base 152. The leg 142 connects to the segment 108 and the base 152. The segments 104-108 are integrally formed or attached to each other via, for example, molding, gluing, welding or threads and screws. The base 152 has a flat bottom surface for stably resting on the top of a flat surface, such as a table surface. The leg 142 and the base 152 are integrally formed or attached to each other via, for example, molding, gluing, welding or threads and screws. The leg 142 and the segment 108 are integrally formed or attached to each other via, for example, molding, gluing, welding or threads and screws.

The segments 104-108 each incorporate an internal cavity. The three cavities of the segments 104-108 communicate with each other, and are adapted to contain liquid. The liquid is poured into the three cavities (collectively referred to herein as the cavity of the container 102) via an outlet 132 of the segment 104, an outlet 134 of the segment 106, or both, Each of the outlets 132-134 can be used to drink the liquid out of the cup 100. The handle 120 is used to hold the cup in hand by a user of the cup 100.

The segments 104-106 extend away from the segment 108 on one side of the segment 108 while the leg 142 extends away from the segment 108 on the opposite side. The segments 104-106 extend away from the segment 108 at two opposite ends of the segment 108. In one embodiment, the segments 104-106 are each perpendicular or substantially perpendicular to the segment 108, which is horizontal. The segments 104-106 are thus termed herein as vertical segments and the segment 108 is termed herein as a horizontal segment. In this embodiment, both the handle 120 and the leg 142 are parallel to the segments 104-106 and vertical.

Figure 2:
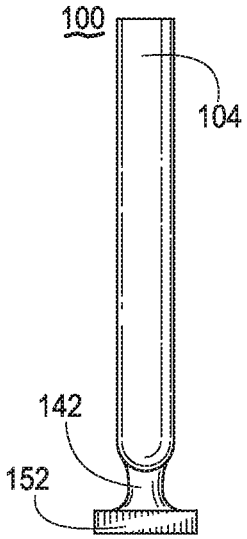
FIG. 2 is a left side view of a beverageware in accordance with this disclosure.
Figure 3:
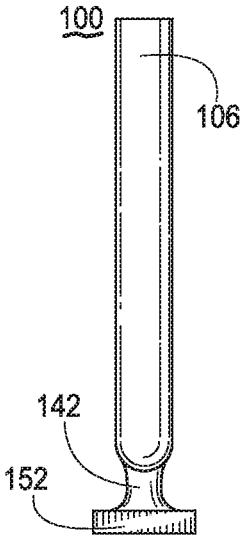
FIG. 3 is a right side view of a beverageware in accordance with this disclosure.
Figure 4:
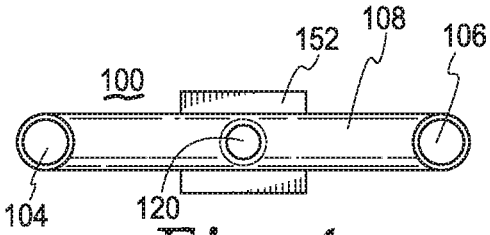
FIG. 4 is a top view of a beverageware in accordance with this disclosure.
Figure 5:
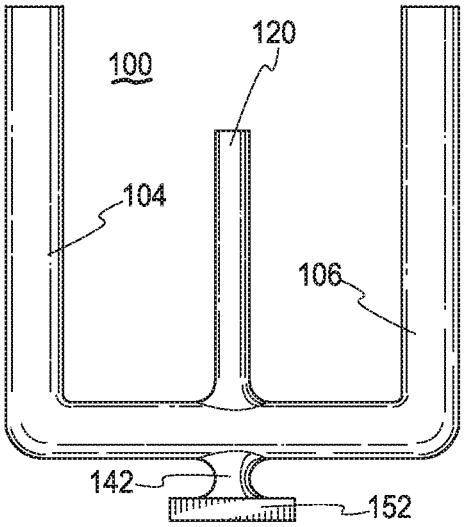
FIG. 5 is a front side view of a beverageware in accordance with this disclosure.
Figure 6:
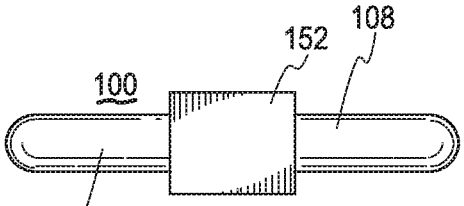
FIG. 6 is a bottom view of a beverageware in accordance with this disclosure.

FIGS. 2 and 3 show the left and right side views of the cup 100 respectively, FIG. 4 shows a top view of the cup 100 while FIG. 6 shows a bottom view of the cup 100. FIG. 5 is a front view of the drinkware 100. The rear view of the cup 100 is similar to the front view of the drinkware 100.

Figure 7:
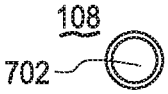
FIG. 7 is a cross-sectional view of a horizontal segment of a container of a beverageware in accordance with this disclosure.

FIG. 7 is a cross-sectional view of the segment 108, The internal cavity of the segment 108 is indicated at 702. The cross-sectional views of the segments 104-106 are similar to that of FIG. 7. When the segment 108 is cylindrical in shape, its cross-sectional view is that shown in FIG. 7. The segments 104-108 can be cylindrical in shape, square prism in shape, rectangular prism in shape, or other geometrical shapes without deviating from the present teachings.

In one implementation, both the handle 120 and the leg 142 extend away from the middle point of the container segment 108 in opposite directions. In such a case, the handle 120 and the leg 142 are coaxial.

Figure 8:
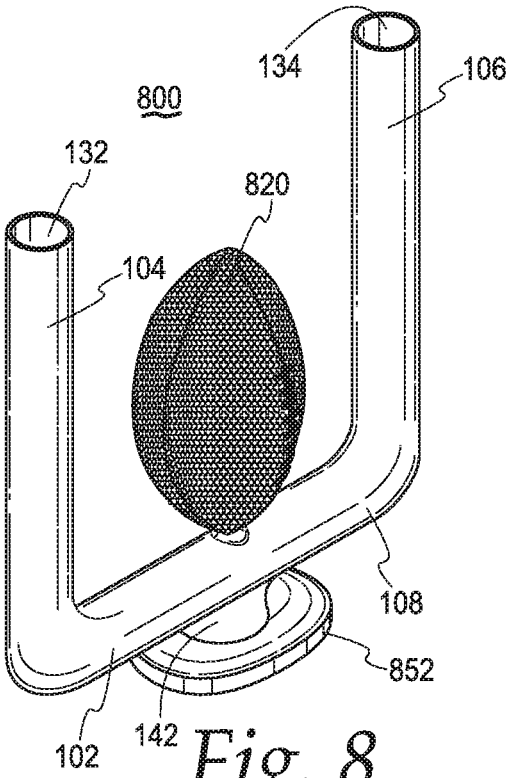
FIG. 8 is a front perspective view of a beverageware in accordance with this disclosure.
Figure 9:
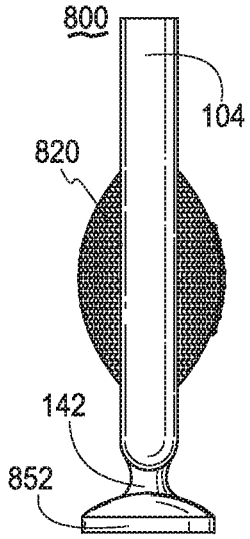
FIG. 9 is a left side view of a beverageware in accordance with this disclosure.
Figure 10:
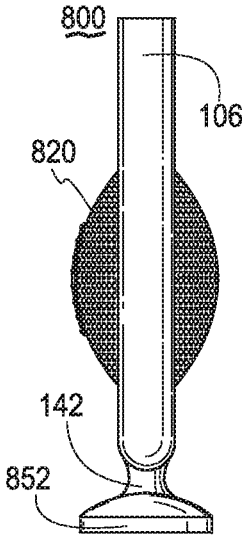
FIG. 10 is a right side view of a beverageware in accordance with this disclosure.
Figure 11:
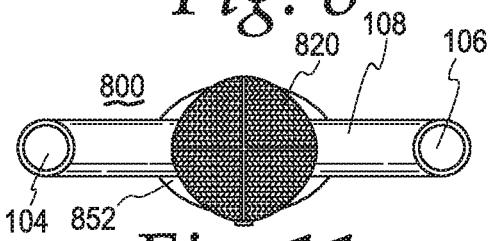
FIG. 11 is a top view of a beverageware in accordance with this disclosure.
Figure 12:
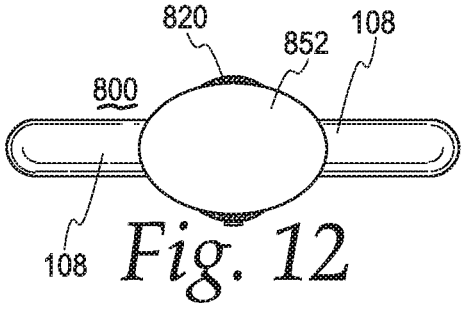
FIG. 12 is a bottom view of a beverageware in accordance with this disclosure.
Figure 13:
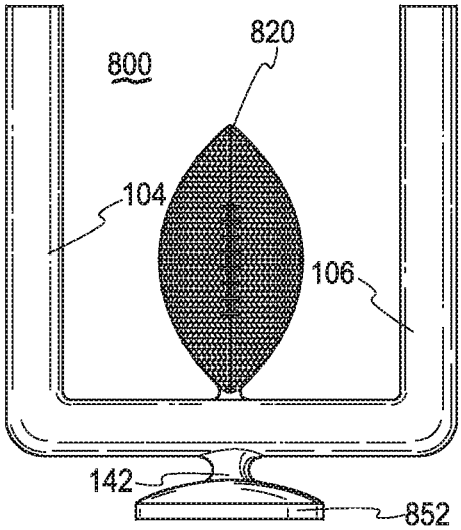
FIG. 13 is a front side view of a beverageware in accordance with this disclosure.
Figure 14:
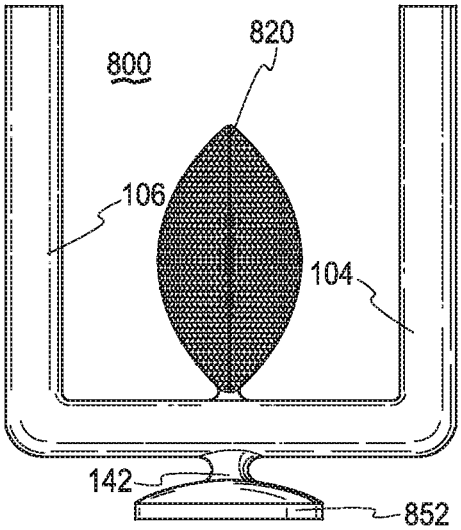
FIG. 14 is a rear side view of a beverageware in accordance with this disclosure.

A further implementation of the beverageware 100 is illustrated by reference to FIGS. 8, 9, 10, 11, 12, 13 and 14. Turning first to FIG. 8, a front perspective view of this implementation is shown and generally indicated at 800. A handle 820 of the cup 800 takes the shape of a football, A base of the cup 800 is indicated at 852. FIGS. 9, 10, 11, 12, 13 and 14 show a left side view, a right side view, v, top view, a bottom view, a front side view, and a rear side view of the beverageware 800 respectively. The cups 100 and 800 can be made of plastics (such as acrylic), metal (such as copper), or other materials. The handle 820 and the leg 142 are coaxial, and extend away from the middle point of the segment 108.

Obviously, many additional modifications and variations of the present disclosure are possible in light of the above teachings. Thus, it is to be understood that, within the scope of the appended claims, the disclosure may be practiced otherwise than is specifically described above.

The foregoing description of the disclosure has been presented for purposes of illustration and description, and is not intended to be exhaustive or to limit the disclosure to the precise form disclosed. The description was selected to best explain the principles of the present teachings and practical application of these principles to enable others skilled in the art to best utilize the disclosure in various embodiments and various modifications as are suited to the particular use contemplated. It should be recognized that the words "a" or "an" are intended to include both the singular and the plural. Conversely, any reference to plural elements shall, where appropriate, include the singular.

It is intended that the scope of the disclosure not be limited by the specification, but be defined by the claims set forth below. In addition, although narrow claims may be presented below, it should be recognized that the scope of this invention is much broader than presented by the claim(s). It is intended that broader claims will be submitted in one or more applications that claim the benefit of priority from this application. Insofar as the description above and the accompanying drawings disclose additional subject matter that is not within the scope of the claim or claims below, the additional inventions are not dedicated to the public and the right to file one or more applications to claim such additional inventions is reserved.

What is claimed is:

1. A beverageware comprising:

a base;

a leg extending upward from said base;

a horizontal container segment supported by said leg and incorporating a first internal cavity, said horizontal container segment being cylindrical in shape;

two vertical container segments extending upward from said horizontal container segment at two opposite ends of said horizontal container segment, said two vertical container segments incorporating a second internal cavity and a third internal cavity respectively, said second internal cavity and said third internal cavity communicating with said first internal cavity, said two vertical container segments each incorporating an outlet communicating with said second and third internal cavities respectively, said two vertical container segments being cylindrical in shape, said outlets adapted to receive liquid; and a vertical, solid, and cylindrical handle having a first end and a second end opposite from said first end, and extending upward from said horizontal container segment, said first end being in contact with said horizontal container segment at a middle point of said horizontal container segment, said second end not in contact with said base, said leg, said two vertical container segments or said horizontal container segment, said handle disposed between said two vertical container segments, wherein said handle and said leg are coaxial.

2. The beverageware of claim 1 wherein said leg extends downward from said horizontal container segment from said middle point.

3. A beverageware comprising:

a base;

a leg extending upward from said base;

a first container segment supported by said leg and incorporating a first internal cavity;

a second container segment and a third container segment extending upward from said first container segment at two opposite ends of said first container segment, said second container segment incorporating a second internal cavity, said third container segment incorporating a third internal cavity, said second internal cavity and said third internal cavity communicating with said first internal cavity, said second container segment incorporating a first outlet communicating with said second internal cavity, said third container segment incorporating a second outlet communicating with said third internal cavity, said first and second outlets adapted to receive liquid; and a solid handle having a first end and a second end opposite from said first end, and extending upward from said first container segment, said first end being in contact with said first container segment, said second end not in contact with said base, said leg, said first container segment, said second container segment or said third container segment, said handle disposed between said second and third container segments.

4. The beverageware of claim 3 wherein said first container segment is horizontal and said second container segment and said third container segment are vertical.

5. The beverageware of claim 4 wherein said handle and said leg are vertical and coaxial.

6. The beverageware of claim 5 wherein said handle and said leg each connect to said first container segment at a middle point of said first container segment.

7. The beverageware of claim 6 wherein said base incorporates a flat bottom surface.

8. The beverageware of claim 7 wherein said beverageware is made of a plastic or metal material.

* * * * *